US011324985B2

(12) United States Patent
Barben

(10) Patent No.: US 11,324,985 B2
(45) Date of Patent: May 10, 2022

(54) RESISTANCE TRAINING BELT

(71) Applicant: Jeffrey Barben, Mendon, UT (US)

(72) Inventor: Jeffrey Barben, Mendon, UT (US)

( * ) Notice: Subject to any disclaimer, the term of this patent is extended or adjusted under 35 U.S.C. 154(b) by 0 days.

(21) Appl. No.: 16/179,964

(22) Filed: Nov. 4, 2018

(65) Prior Publication Data

US 2020/0139185 A1 May 7, 2020

(51) Int. Cl.
*A63B 21/055* (2006.01)
*A63B 21/00* (2006.01)

(52) U.S. Cl.
CPC .... *A63B 21/0555* (2013.01); *A63B 21/00185* (2013.01); *A63B 21/4034* (2015.10); *A63B 21/4035* (2015.10); *A63B 2225/09* (2013.01)

(58) Field of Classification Search
CPC ..... A63B 21/4035; A63B 21/4034; A63B 21/00185; A63B 21/0555; A63B 5/04; A63B 5/20; A63B 7/04–085; A63B 21/02; A63B 21/0552–0557; A63B 21/055
See application file for complete search history.

(56) References Cited

U.S. PATENT DOCUMENTS 4,251,071 A * 2/1981 Norton ..... A63B 21/0004 482/125
4,570,921 A * 2/1986 Arnold ..... A63B 21/0004 482/125
4,969,644 A * 11/1990 Hlaing ..... A63B 21/0004 482/126
D328,320 S * 7/1992 Hliang ..... D21/692
5,518,481 A * 5/1996 Darkwah ..... A63B 21/0004 482/126
5,816,984 A * 10/1998 Weiss ..... A63B 21/0552 482/121
8,157,712 B1 * 4/2012 Musachio ..... A63B 21/4034 482/121
D670,345 S * 11/2012 Guarrasi ..... D21/662
8,944,976 B2 * 2/2015 Crowell ..... A63B 21/0442 482/121
9,248,331 B1 * 2/2016 Collier ..... A63B 21/0555
9,914,005 B2 * 3/2018 Zadman-Zeman ..... A63B 21/0004
D852,908 S * 7/2019 Dennisur ..... D21/692
2004/0067827 A1 * 4/2004 Tustin ..... A63B 21/0004 482/121
2006/0217247 A1 * 9/2006 Potak ..... A63B 21/0004 482/121
2007/0105696 A1 * 5/2007 Castel ..... A63B 71/06 482/121
2008/0058180 A1 * 3/2008 Clarke ..... A63B 21/0004 482/126
2008/0081746 A1 * 4/2008 Woodruff ..... A63B 21/0004 482/121

(Continued)

*Primary Examiner* — Loan B Jimenez
*Assistant Examiner* — Catrina A Letterman
(74) *Attorney, Agent, or Firm* — Steven Rinehart

(57) ABSTRACT

A portable resistance training belt woven from polymeric materials to perform a resistance exercises, the belt adapted to extend between limbs to perform a variety of resistance exercises. The resistance training belt may be used for isomeric training in some embodiments. In other embodiments, the belt is adapted to stretch at a predetermined tensile force rating. The belt may two terminal ends and alternatively comprise segments having printed, relief, or recessed indicia.

6 Claims, 4 Drawing Sheets

(56) References Cited

U.S. PATENT DOCUMENTS

| | | | | |
|---|---|---|---|---|
| 2009/0069729 | A1* | 3/2009 | Burns | A61H 11/00 601/134 |
| 2013/0059702 | A1* | 3/2013 | Page | A63B 21/0442 482/125 |
| 2013/0196831 | A1* | 8/2013 | Kinsbourne | A63B 21/4035 482/129 |
| 2015/0297937 | A1* | 10/2015 | Burkinshaw | A63B 23/12 482/124 |
| 2016/0206914 | A1* | 7/2016 | Zaki | A63B 21/0552 |
| 2016/0310777 | A1* | 10/2016 | Crowell | A63B 21/0555 |
| 2017/0189758 | A1* | 7/2017 | Angulo | A63B 21/16 |
| 2017/0252597 | A1* | 9/2017 | Klein | A63B 21/0555 |
| 2018/0318630 | A1* | 11/2018 | Young | A63B 21/00058 |

* cited by examiner

RESISTANCE TRAINING BELT

FIELD OF THE INVENTION

This invention relates to a resistance system that provides a resistance exercise training, and more particularly relates to a resistance system which uses a band or belt for tensile resistance training.

BACKGROUND

Description of the Related Art

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Engaging in regular exercise is a well-established necessity in healthy living. Businessmen and travelers often lack the time and ability to exercise at commercial gymnasiums and would find it more convenient to exercise if efficient portable devices existed in the art. Parents and individuals at home would also exercise more often if standard exercise equipment available in-home settings were not prohibitively large, expensive and cumbersome for home use. Varied types of compact exercise devices have been developed over the years to replace cumbersome gym equipment for travelers and in home settings and assist individuals in their efforts to improve general strength, endurance and/or to mitigate specific health issues, but all of these apparti suffer from a number of inefficiencies.

The prior art includes complicated apparati comprising flexible rods, bungee cords, and inflatable tensile devices used for a large variety of conditioning activities such as increasing core strength and muscle tone. Some exercise devices employ elastomeric resistance tubes as a means of developing or measuring strength, but often these devices are designed with very limited exercises or muscle groups in mind. Importantly, because these tubes are cylindrical and prone to twisting, the tubes tend to slip off users' feet and hands, suddenly recoiling upwards and injuring the user. In some cases, tubing has blinded one or more eyes of users or lacerated or bruised portions of the body coming in contact with the tubing. Even straps formed from unwoven straps or bands of material tend to tear or break at points of the band exerted to direct pressure or stress, potentially ripping and whiplashing a user.

There are no handheld devices in the art which effectively exercise all the muscle groups in user's arms, legs and core which are compact enough for carry on luggage. It would be desirable to provide a resistance device adapted to be used to exert tensile force on arms and legs simultaneously to tear muscle for rebuilding tissue and increasing strength.

Such a resistance training device would offer low cost, portability, ease-of-use and versatility for performing a variety of resistance exercises compared to dumbbells and steel exercise machines. Simple, low cost design elements and broad fitness and therapeutic applications, resistance bands with selective resistive force would be beneficial in the art.

In view of the foregoing, it is clear that these traditional resistance training devices leave room for more optimal approaches.

SUMMARY

From the foregoing discussion, it should be apparent that a need exists for a resistance system that provides enhanced resistance training and enables realistic simulation of movements during a resistance exercise. Beneficially, such an apparatus would provide a plurality of features and components efficacious for resistance training. The present invention has been developed in response to the present state of the art, and in particular, in response to the problems and needs in the art that have not yet been fully solved by currently available apparatus. Accordingly, the present invention has been developed to provide a resistance belt for resistance training exercises, the resistance system consisting of: an elongated, woven polymeric strap having two terminal ends adapted to stretch when a force exceeding a predetermined threshold is applied thereto during resistance training exercises. The predetermined threshold may exceed 50 Newtons.

The belt may further comprise a plurality of elongated segments, each segment indicated with an alternative color.

The belt may further comprise a plurality of elongated segments, each segment indicated with an alternative numeral, the numeral indicative of one of: a user height, a user strength, a particular exercise realized by gripping said elongated segment.

The elongated segments may be detachable.

The belt may further comprise a plurality of elongated segments, each segment indicated with an alternative numeral, the numeral indicative of one of: a user height, a user strength, a particular exercise realized by gripping said elongated segment.

In some embodiments, the belt further comprises a plurality of metered segments having texture. Each metered segment may indicate a foot position for a particular exercise.

Each metered segment may be thicker through a length of the metered segment than through the remaining portion of the strap.

The apparatus may further comprise a plurality of colored bands, each colored band indicating a tensile force rating of the apparatus at the band.

The apparatus may further comprise handles. The belt may be adapted for isometric exercise. The strap may be woven, in some embodiments, from threads comprising two or more of nylon, latex, polyether-polyurea copolymer and leather.

A second resistance belt for resistance training exercises is provided, the resistance system consisting of: a woven elongated polymeric strap having two terminal ends adapted to stretch when a force exceeding a predetermined threshold is applied thereto during resistance training exercises; a plurality of elongated segments, each segment indicated with one of a color and a numeral, the color and numeral indicative of one of: a hand position for a particular exercise, a foot position for a particular exercise, a tensile force rating for the strap at the segment; wherein each elongated segment is thicker than the strap.

A third resistance belt for resistance training exercises, the resistance system comprising: an uninterrupted, elongated polymeric strap adapted to stretch when a force exceeding a predetermined threshold is applied thereto during resistance training exercises; wherein the belt further comprises a plurality of elongated segments, each segment indicated with one of a color and a numeral, the color and numeral indicative of one of: a user height, a user strength, a particular exercise realized by gripping said elongated segment; wherein the belt further comprises a plurality of elongated segments, each segment indicated with an alternative color.

The elongated segments may be detachable. The apparatus may further comprise a plurality of metered segments having texture for engaging a foot position in a particular exercise.

The apparatus may further comprises a plurality of colored bands, each colored band indicating a tensile force rating of the apparatus at the band.

The strap may be woven from threads comprising two or more of nylon, latex, silicone, polyether-polyurea copolymer and leather.

The apparatus further comprises, in some embodiments, a plurality of polymeric straps of differing lengths layered one upon another.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to convey a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1:
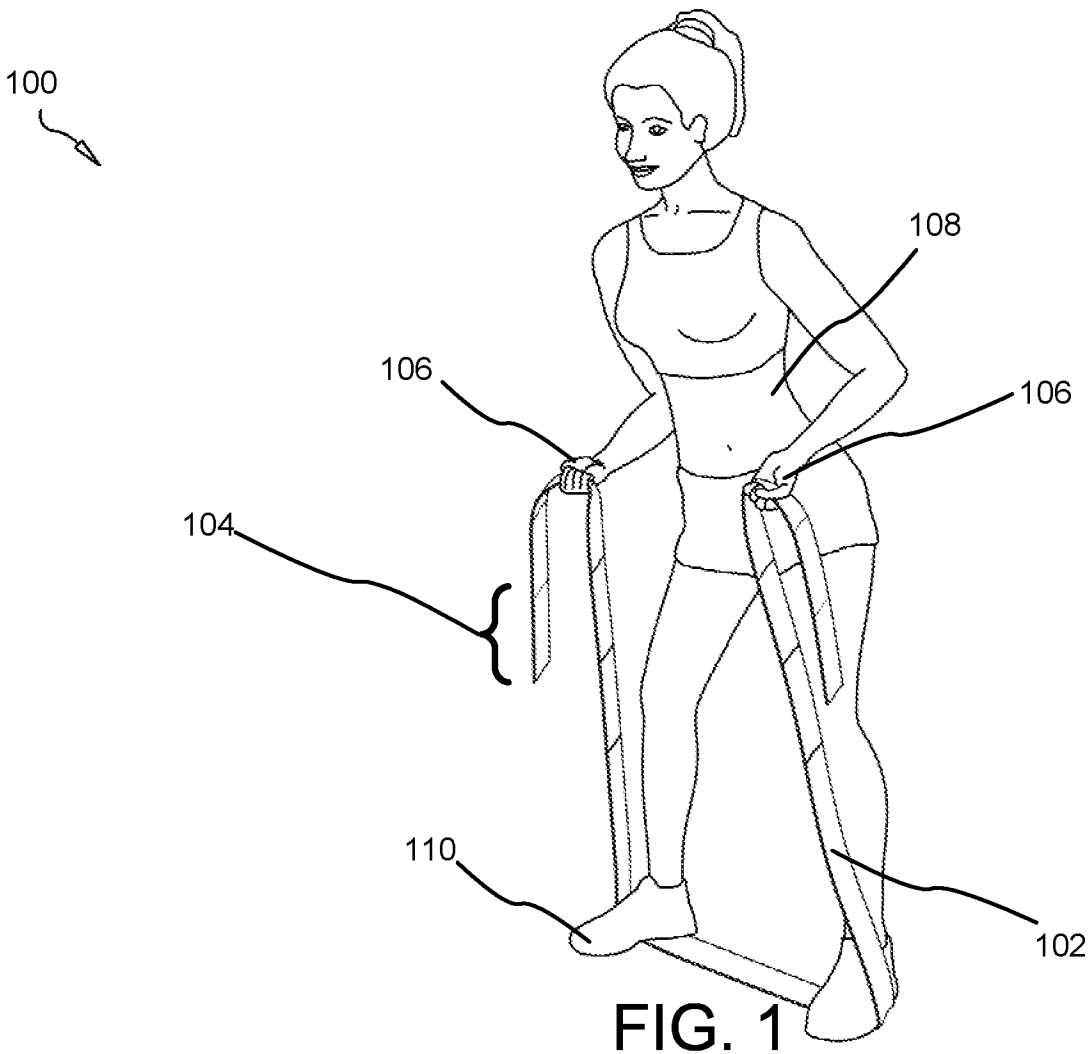
FIG. 1 is an environmental forward perspective view illustrating an exemplary resistance training belt in accordance with the present invention.

FIG. 1 is an environmental forward perspective view illustrating an exemplary resistance training belt 100 in accordance with the present invention.

The belt 100 comprises a band 102 which may be formed in whole or in part from polymeric materials or organic materials (e.g., leather) and may include, without limitation, rubber, latex, nylon, and polyester. Those skilled in the art will recognize that the length, thickness, and material composition of the band 102 is determinative of the tension force generated while pulling and stretching the device 100. The strap 102 may comprise a woven elastomeric cloth. Alternatively, the band 102 may be formed from organic or synthetic latex, or polyester. The woven structure of the band 102 is adapted to prevent tearing of the band 102 and to prevent the band 102 from arbitrarily twisting and slipping off toes, feet or hands than whiplashing a user, as is common with traditional exercise bands formed from surgical tubing.

The belt 100 is shown in the stretched position. The belt 100 may be configured to perform a resistance exercise to build strength and dexterity by wrapping the belt 102 around the feet 110 and hands 106 of user 108. The resistance exercises performed with the belt 100 include pushing and pulling exercises in which tensile force is applied to the band 102 between opposing bodily limbs such as feet 110 and hands 106. These resistance exercises may develop balance and stability muscles including stabilizing muscle not activated by dumbbells, as the muscles are forced to maintain the lateral stability of limbs during resistance exercises. The thickness of the band 102 is predetermined to withstand tensile force up to a predetermined force, measured in Newtons in some embodiments. In other embodiments, the belt 100 does not substantially stretch or flex and is adapted for purely isomeric exercise.

The belt 100 is adapted to stretch when tensile force is applied thereto in some embodiments. The band 102 generates a tension force when pulled or stretched between various limbs 110, 106 of the body of a user 108. It is resistance to this tension force that provides the training and development of the muscular system.

The forces applied to the belt 100 may include an upward, a downward force, or axial rotations forces (torque) in which the belt 100 is twisted while being stretched to strain and build tendons and stabilizer muscles of a user 108. The user 108 may twist, or torque, the belt 100 in the course of resistance exercise.

These belt 100 as shown comprises two terminal ends 104 which are gripped, or wrapped around, hands 106. Tensile forces applied to belt 100 are applied through hands 106 which are typically used to pull against the belt 100 the handles 104 by the hands of user. In some embodiments, the user 108 stretches the belt 100 against the hands, knees, elbows, and/or other parts of the user's 108 body to perform resistance training exercises.

Figure 2:
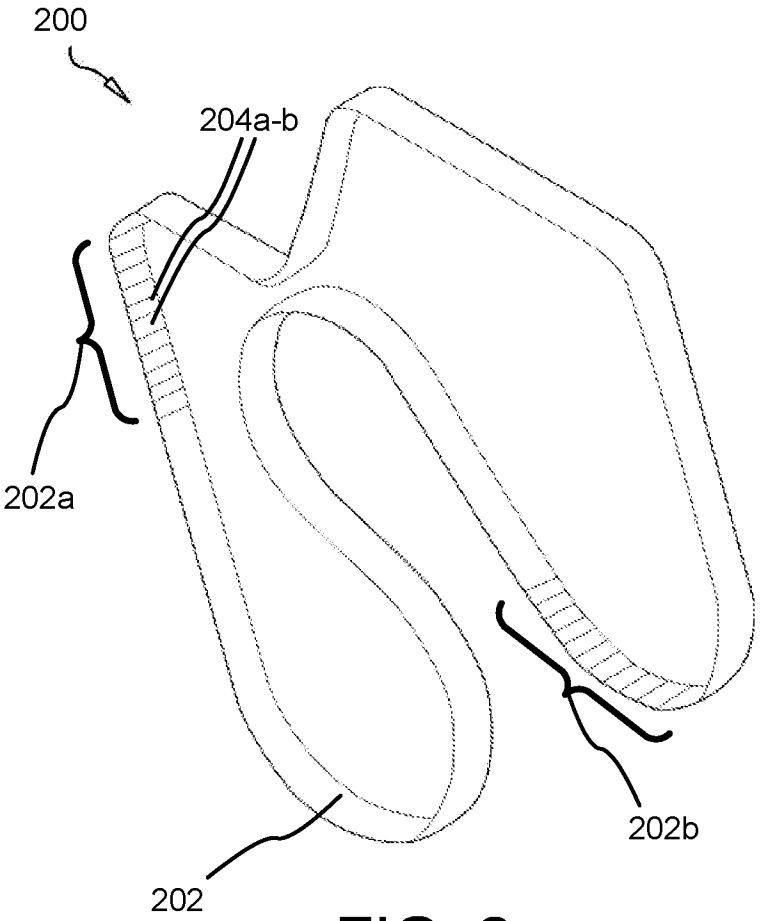
FIG. 2 is a side, forward perspective view illustrating an exemplary resistance training belt in accordance with the present invention.

FIG. 2 is a side, forward perspective view illustrating an exemplary resistance training belt 200 in accordance with the present invention.

The belt 200 may comprise an uninterrupted annular band 202 as shown. In various embodiments, the belt 202 comprises one or more metered segments 202*a-b* which have texture for engaging the hands 106 of a user 108. The texture may be applied using means known to those of skill in the art and may indicate a position point for grip of the band 102 during resistance training exercises. These metered segments 202*a-b* may also comprise color-coordinated bands 204 indicating a measure of force applied if resistance exercises are performed with the hands 106 gripping the indicated color-coordinated band 204 and/or metered segment 202*a-b*. These metered segments 202*a-b* may also comprise numerals indicated a recommended hand position corresponding with a height of a user 108, a sex of a user 108, and/or strength measurement of a user 108 (such as advanced users 108 who have built significant strength or beginners).

The metered segments 202 may also indicate a foot 110 position for a particular exercise (e.g., indicate a position where a foot 110 engages the belt 200 for a particular exercise a user 108 intends to realize). The metered segments 202*a-b* may be coated in a flexible synthetic padding. In various embodiments, the metered segments 202*a-b* are thicker through the metered segment 202*a-b* portion of the band 202 than through the non-metered portions of the band 202.

The uninterrupted belt 202 may also be useful in performing resistance exercises not involving the hands 106 or not reliant upon the grip of the hands to realize the exercise, including the exercise of various muscles throughout the torso, legs, and arms using multiple tension forces, done while sitting or standing or pandiculating.

Figure 3:
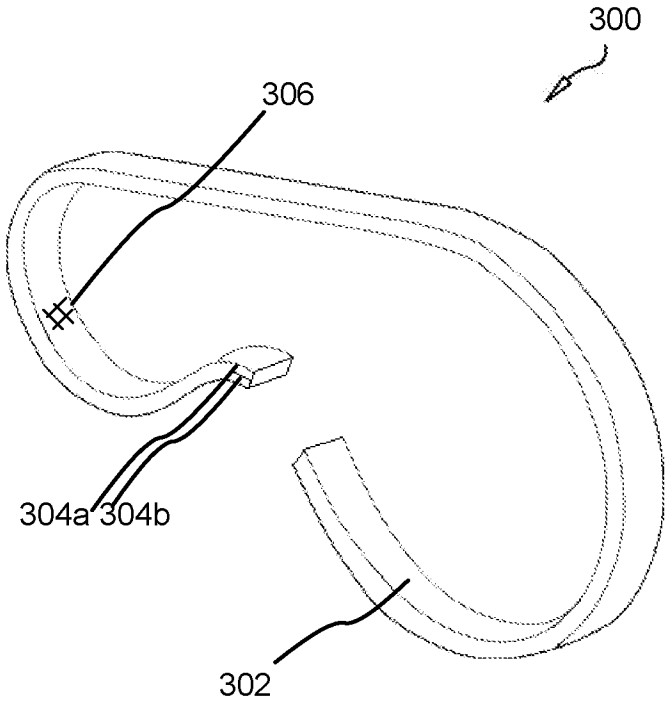
FIG. 3 is a side, forward perspective view illustrating an exemplary resistance training belt in accordance with the present invention.

FIG. 3 is a side, forward perspective view illustrating an exemplary resistance training belt 300 in accordance with the present invention.

The band 302 may include a plurality of polymeric bands 304 layered one on top of another, with exterior bands having longer circumferences that interior bands to maintain a curved exterior shape or aesthetic. One or more of the layers 304*a-b* may be formed from woven threads of nylon, silicone, latex, polyesters and/or organic materials, all to prevent tearing and breaking of the band 102, which is common with traditional exercise bands. In various embodiments, the strap (or band) 102 comprises synthetic fibers threads woven into the band 102 structure, such as a polyether-polyurea copolymer like Spandex™.

In some embodiments, the physical characteristics of the layered band 302 enable a user 108 to keep constant tension on the muscles and joints during resistance training exercises.

The belt 300 may be wrapped around hands 106 or knotted to form a continuous piece. The belt 300 may comprise woven threads 306 as shown and described herein, including silicone threads.

Figure 4:
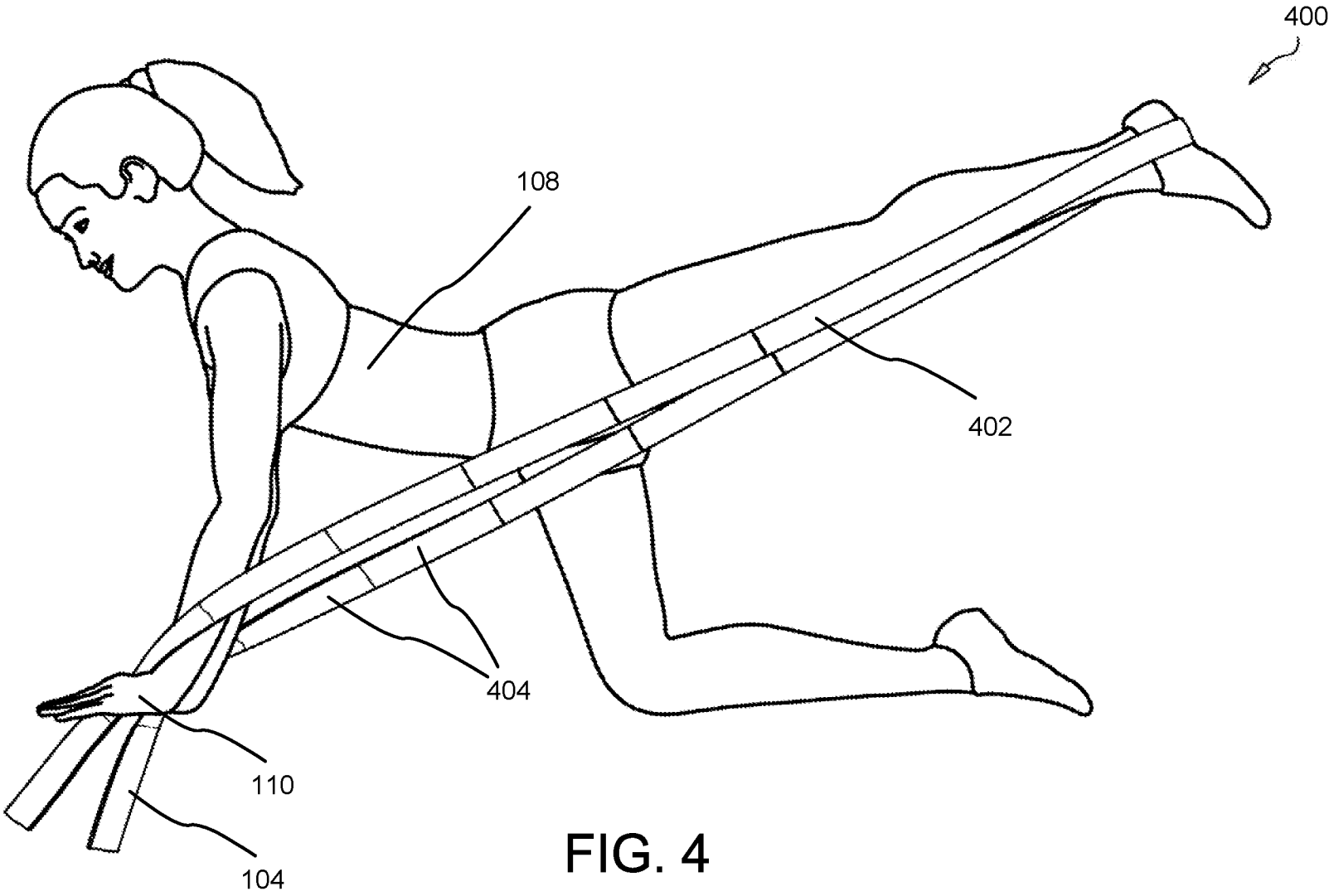
FIG. 4 is an environmental forward perspective view illustrating an exemplary resistance training belt in accordance with the present invention.

FIG. 4 is an environmental forward perspective view illustrating an exemplary resistance training belt 400 in accordance with the present invention.

Although not shown, the belt 400 may comprise handles, or cylindrical members defining hollow passageways, through which the belt 102 traverses. The handles may be heat-pressed onto the belt 102. The handles may also include annular, toroid or donut-shaped handles.

The band 402 may provide a different length and tension settings for creating the different tension forces through addition or redaction of sections 404. The band 402 may be formed from a plurality of elongated sections 404 which may differ in color or markings. These elongated sections 404 may be formed as a single integrated piece.

Alternatively, the elongated sections 404 may be detachable using means known to those of skill in the art. The elongated sections 404 may comprise clips, buckles, inserts or fasteners which conjoin and/or interlock one section 404 with another to form the band 402.

In various embodiments, the sections 404 vary in thickness and/or density such that one section 404 varies in the tensile force it can withstand before stretching, breaking or deforming from another section 404. In these embodiments, the addition of one section 404 to the band 402 may result in a non-uniform tensile strength change to the overall belt 400 from addition of another section 404. The sections 404 may affix at intermediate points to the band 402.

The belt 400 may be adapted to flex only when the tensile force applied to the belt 400 exceeds a predetermined threshold, which may be anywhere between 20 and 1000 Newtons of force.

Figure 5:
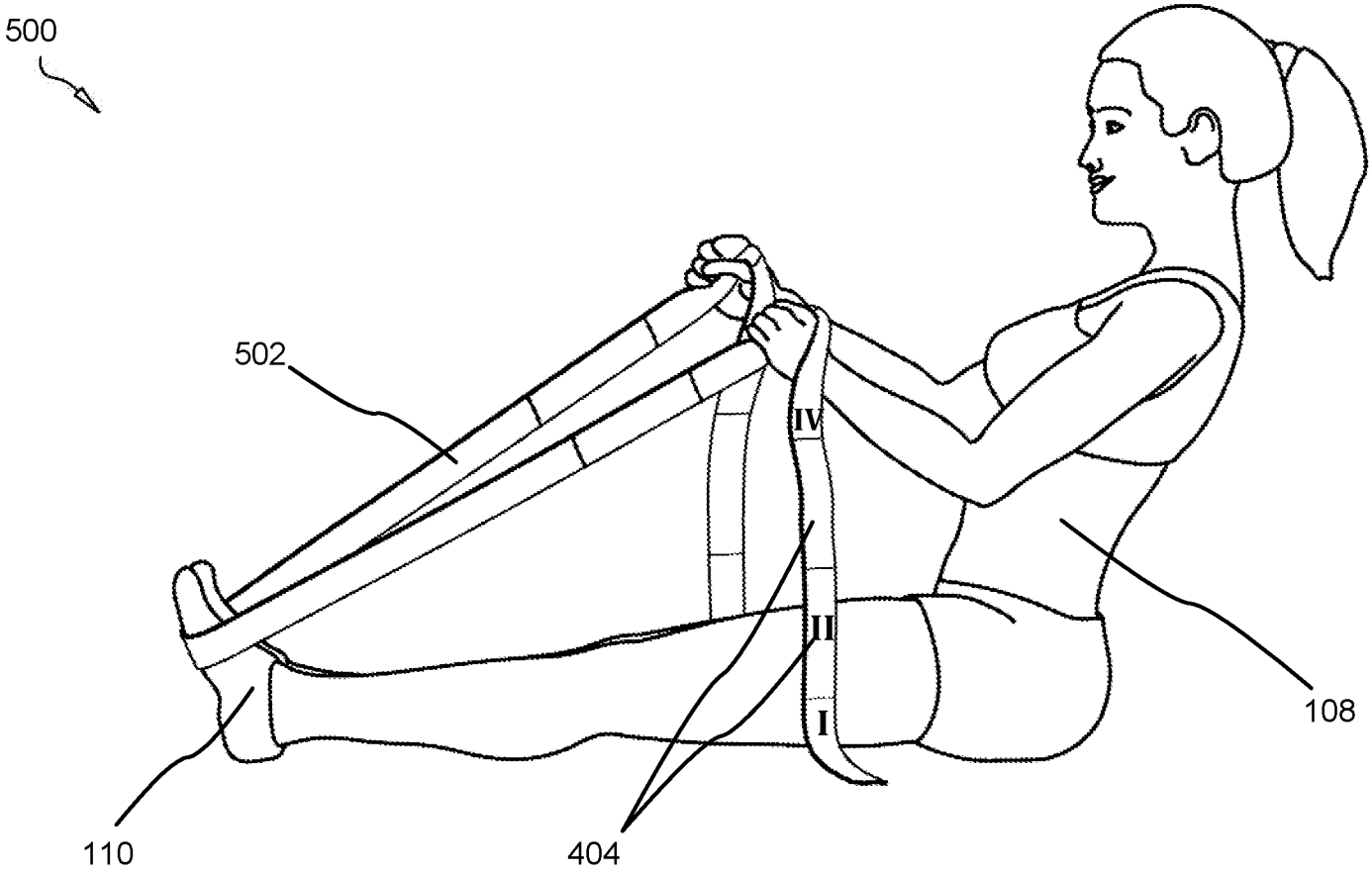
FIG. 5 is an environmental forward perspective view illustrating an exemplary resistance training belt in accordance with the present invention.

FIG. 5 is an environmental forward perspective view illustrating an exemplary resistance training belt 500 in accordance with the present invention.

In some embodiments, the belt 502 functions to perform a resistance exercise in sitting position as shown, extending around the feet 110 of a user 108. In these embodiments, a shorter user 108 may grip the belt 502 at different positioning from a taller user 108. In the shown embodiment, the user 108 is gripping the belt 500 at indicated position V (or on the fifth elongated section 404).

The numerals indicated on the sections 404 may indicated the grip position for users of different heights for different exercises. These numerals may also indicate the tensile force needed to stretch or deform the belt 500 at different positions, or an overall length of the belt 500 measured to the indicated positions. The numerals may also be indicia of an exercise intending to be performed with hands 106 at the indicated position.

In this manner, a variety of resistance exercises may be realized with optimal function and benefit to a user 108 as is an object of the present invention.

Accordingly, the present invention has been developed to provide a belt 100-500 for creating tension and resistance exercises for developing and training The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A resistance belt for resistance training exercises consisting of:

two or more elongated, woven polymeric straps layered on top of each other to form a curved exterior shape;

wherein the resistance belt having two terminal ends unaffixed to any other component adapted to stretch when a force exceeding a predetermined threshold is applied thereto during the resistance training exercises;

wherein the elongated woven polymeric straps are affixed flush with one another without either loops or separation points between the two terminal ends;

wherein the curved exterior shape has an exterior polymeric strap and an interior polymeric strap, the exterior polymeric strap being longer than the interior polymeric strap;

wherein the woven polymeric straps are each textured at two or more points to indicate a grip position point.

2. The resistance belt of claim 1, wherein the predetermined threshold exceeds 50 Newtons.

3. The resistance belt of claim 1, wherein the resistance belt further consists of:

a plurality of elongated segments, each of the plurality of elongated segments indicated with an alternative color, each of the plurality of elongated segments associated with a recommended hand position and height of a user;

a plurality of metered segments having texture;

wherein each of the plurality of elongated segments is indicated with a numeral indicative of one of a tensile force needed to deform the belt.

4. The resistance belt of claim 3, wherein each of the plurality of metered segments indicates a foot position for a particular exercise.

5. The resistance belt of claim 1, wherein the belt is adapted for isometric exercise.

6. The resistance belt of claim 1, wherein the woven polymeric strap is woven from threads comprising two or more of nylon, latex, polyether-polyurea copolymer and leather.

* * * * *